United States Patent [19]

Kackenmeister

[11] 4,430,599

[45] Feb. 7, 1984

[54] TUNGSTEN-HALOGEN LAMP WITH FREE FLOATING GETTER

[75] Inventor: Carl F. Kackenmeister, Williamsport, Pa.

[73] Assignee: GTE Products Corporation, Stamford, Conn.

[21] Appl. No.: 372,594

[22] Filed: Apr. 28, 1982

[51] Int. Cl.[3] ..... H01K 1/50; H01K 1/56

[52] U.S. Cl. ..... 313/554; 313/557; 313/579

[58] Field of Search ..... 313/579, 559, 557, 553, 313/554

[56] References Cited

U.S. PATENT DOCUMENTS 4,361,780 11/1982 Brons ..... 313/579 X

FOREIGN PATENT DOCUMENTS 2067832 7/1981 United Kingdom ..... 313/557

*Primary Examiner*—Palmer C. Demeo

*Attorney, Agent, or Firm*—William H. McNeill

[57] ABSTRACT

A tungsten-halogen lamp employs a quantity of loose copper particles within the envelope to function as an oxygen getter. The loose particles allow the copper to be positioned in the lowest, and thus coolest, part of the lamp whereby the lamp can be burned in any orientation.

3 Claims, 1 Drawing Figure

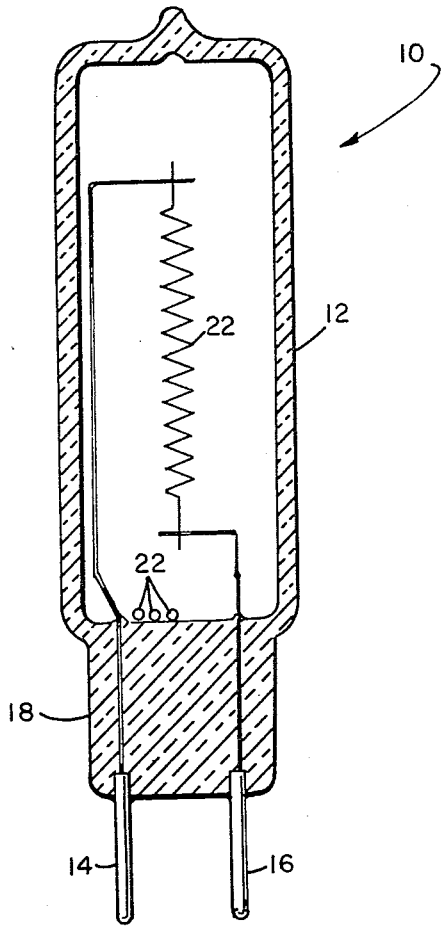
10
12
22
22
18
14
16

TUNGSTEN-HALOGEN LAMP WITH FREE FLOATING GETTER

CROSS-REFERENCES TO RELATED APPLICATIONS

Application Ser. Nos. 372,512, 372,508, 372,519, and 372,518, filed concurrently herewith and assigned to the assignee of the instant application, contain related subject matter.

TECHNICAL FIELD

This invention relates to incandescent lamps and more particularly to tungsten-halogen incandescent lamps. Still more particularly it relates to lamps of the latter variety having means incorporated therewith to prevent filament sagging, thus allowing long life and the ability to be lighted in either a vertical or horizontal mode.

BACKGROUND OF THE INVENTION

The majority of incandescent lamps today use a filament made from tungsten wire which can be of the single or coiled coil design. When initially energized to incandescence, the filament will both metallurgically recrystalize and physically sag under gravitational attraction.

Coiled coil filaments sag more than single coils and fine wire sags more than heavy wire.

In the vertical position sag is characterized by a collapsing of turns with open turns at the top and compression at the bottom. Sag in the horizontal position is characterized by the formation of one or more catenaries depending on the number of filament support wires.

The preliminary sag in tungsten filaments has never been completely eliminated. However, it can be significantly reduced by employing a controlled heating process at the time of initial lightup. Two different processes for doing this are now in common use and are briefly described as follows.

1. Pre-stabilizing is a process used mainly on coiled coil filaments for halogen lamps. It involves raising the coil temperature above 2400° C. in vacuum prior to removing the primary mandrel and while the secondary coiling is mounted on a threaded rod. The result is a brittle coil which requires hand mounting. This, plus the pre-stabilizing process make for a very expensive coil. However, preliminary sag at initial coil lightup is minimal.
2. Flashing is an alternate method of stabilizing the filament. It is done after the coil is mounted in the lamp and can be performed either before or after tipoff. Since the filament as received is not brittle, it does not require hand mounting and can therefore be mounted inexpensively via high speed automatic equipment. Initial lightup under these conditions results in more preliminary sag than on pre-stabilized coils.

Unfortunately, the filament in an incandescent lamp will continue to sag during subsequent lamp operation in spite of pre-stabilizing or flashing. This is generally attributed to a slippage at the grain boundaries. The condition is known to be aggravated by the presence of oxygen in the vapor state. This accounts for a higher degree of sag in halogen lamps because the halogen regenerative cycle retains a higher percentage of oxygen in the vapor state than there is in a non-halogen incandescent lamp. Generally, the sag in non-halogen incandescent lamps is not severe because most of the residual oxygen is tied up on the bulb wall as tungsten-oxide, a colorless solid condensate. Thus, a sufficient quantity of oxygen is not available in the vapor state to promote sag.

However, in halogen lamps secondary sag can be a serious problem due to the fact that any oxides present can be reduced by the halogen additive (HBr in this case) which promotes the presence of free oxygen in the vapor state.

As was the case with preliminary sag, fine wire filaments of the coiled coil configuration are especially susceptible to severe secondary sag in a halogen atmosphere. Also, chemical corrosion of the wire in the cooler sections of the filament results in a significant reduction in life as caused by thinning and premature arcing. This is more pronounced in fine wire than it is in heavy wire.

These problems become even more aggravated in the case of a tungsten-halogen lamp employing a low wattage, line voltage, coiled coil filament. An example of such a coiled coil would be one rated at 100 watts and 120 volts. Such a coil is formed from fine tungsten wire (12.5 mg/200 mm with a diameter of 0.0025 inches) and filament sag and short life due to the presence of the halogen would be a serious problem.

The use of halogen in an incandescent lamp generally allows for an envelope which is drastically reduced from the size that would be required by a non-halogen version of the same wattage. Specifically, the 100 watt filament described above is normally sealed in an A19 glass bulb under non-halogen conditions but can be sealed in a T5 glass envelope when halogen is added. The relative volumes of these two bulbs are:

$$A19 = 130 \text{ cc} \quad 1.$$

$$T5 = 5.2 \text{ cc} \quad 2.$$

The use of this drastically smaller T5 envelope provides for higher fill pressures which in turn results in a lamp performance increase. However, the filament is now significantly closer to the bulb wall of the T5 and filament sag while burning in any position other than the vertical results in the coil moving closer to the wall. The result is a local increase in bulb wall temperature with a corresponding increase in outgassing of the glass which can be deleterious to lamp performance. In the most severe case, the filament can (and has) sagged to the point where it makes contact with the bulb wall. The result is thermal cracking or melting of the bulb wall which terminates lamp life prematurely.

There are numerous techniques now in use attempting to solve the problem of sag in halogen lamps of this type. However, each one introduces new problems which forces a compromise with respect to lamp performance. Some of the more widely used techniques are briefly described here.

1. Center Support—Sag reduction can be restricted significantly by using a third wire which loops around the center of the coil and is electrically isolated from the two end lead wires. Sag in any position except vertical will result in two catenaries whose displacement from the original coil center line is less than that of an unsupported single catenary. However, contact between coil and support results in a local cool spot which then becomes the center of increased halogen activity with its associated tungsten corrosion. The coil will ultimately fail prematurely due to the accelerated thinning in the area of contact with the center support wire. Also, a center support makes lamp manufacture more difficult and costly.

2. Pre-Stabilized Coil—As previously described, this process results in less overall sag but is restricted to hand mounting due to coil embrittlement. This latter restriction results in a significant increase in manufacturing costs which is intolerable in low cost lamp types, such as would be suitable for general home illumination.
3. Methane Light Up—This is a well-known process employed during the lamp exhaust cycle whereby the filament is energized in an atmosphere of nitrogen and methane ($CH_4$). The literature alludes to reduced coil sag as a result and attributes this benefit to a reaction between the tungsten filament and the carbon in the methane. However, tests run on a 100 watt, 120 volt coil, such as that described above, resulted in absolutely no reduction in coil sag when compared with control lamps which were not lighted in methane.
4. Other Halides—The halogen additive often used is Hydrogen Bromide (HBr). It is considered by some lamp manufacturers to be too corrosive and therefore less desirable than the carbonaceous halides. Tests run fail to show any advantages to using this type of halide ($CH_2Br_2$, for example). A serious defect arises when using this gas. The result is a significant attenuation of light output which is caused by a carbon layer deposited on the inner bulb wall during initial lightup when the $CH_2Br_2$ is decomposed into a more elemental form.
5. Reduced Halogen Content—It has been shown by tests that a reduction in halogen content in the fill gas will give rise to a corresponding reduction in filament sag and corrosion. Unfortunately, it will also result in an increase in the percentage of lamps which will turn black prematurely due to failure of the halogen regnerative cycle. Lamp blackening of any halogen lamp constitutes lamp failure even if the filament continues to burn. No reputable lamp manufacturer would tolerate such a condition.
6. Condenser Discharge Flashing—This is a process which attempts to achieve the results displayed by a pre-stabilized filament while circumventing the brittle coil/hand mount problems of the latter. It involves stabilizing the filament after mounting either during the exhaust cycle or after tipoff. A condenser is used to discharge a high energy pulse through the coil. The pulse duration is very short compared to the conventional series-ballast flashing process used by many lamp manufacturers. This shorter time duration significantly reduces the heat sinking effect on the coil's metallurgical structure by the lead-in clamps. Thus, the coil is allowed to stabilize more completely in the clamp area from where much of the sag problem emanates. However, it is felt that this method will achieve, at best, only a portion of the effect desired, and that at increased cost of manufacture.
7. Low Sag Coil Design—It has been demonstrated that the coil design which exhibits the last amount of sag is one which has the tightest T.P.I. and lowest mandrel to wire (coil) ratio with respect to both the primary and secondary windings of the CC8 filament. All of this must be done, however, within the allowable limits of prescribed coil manufacturing practice. Like condenser discharge flashing, it is felt that low sag coil design will achieve only a portion of the desired effect.

DISCLOSURE OF THE INVENTION

It is, therefore, an object of this invention to obviate the disadvantages of the prior art.

It is another object of the invention to enhance tungsten-halogen lamps.

Yet another object of the invention is to significantly reduce primary and secondary filament sag in incandescent lamps.

Still another object of the invention is the provision of a tungsten-halogen lamp which can be employed in a horizontal mode or in a vertical mode with base up or base down.

These objects are accomplished, in one aspect of the invention, by the provision of a tungsten-halogen incandescent lamp incorporating therein a quantity of loose copper particles.

It is believed the copper functions as an oxygen getter. When provided within the lamp as loose particles, the cooper will find its way to the lowest, and coolest, area of the lamp, where its function as an oxygen getter is greatly enhanced.

BRIEF DESCRIPTION OF THE DRAWING

The single FIGURE diagrammatically illustrates an embodiment of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

Referring now to the drawings with greater particularity, there is shown in the figure a tungsten-halogen lamp 10 having a glass envelope 12 of a suitable material such as a borosilicate or aluminosilicate glass. Lead-in wires 14 and 16 are sealed in envelope 12, as at press 18. The lead-in wires are formed from a material, such as molybdenum, which will form a relatively strain free, hermetic seal with the glass envelope.

A tungsten filament 20, such as a coiled coil designed, for example, for 100 watt, 120 volt operation, is attached to the internal ends of the lead-in wires and the envelope is filled with a fill gas comprising an inert gas and a halogen. In a preferred embodiment the fill gas comprises 88% krypton; 11.79% nitrogen, and 0.21% hydrogen bromide at a pressure of about 5 atmospheres absolute at room temperature.

A quantity of loose copper particles 22 is enclosed within the envelope 12. The amount of copper is sufficient to provide the required gettering and the particles should be small enough so as not to pose a shock hazard to filament 20. In a T5 envelope having a volume of 5.2 cc, 0.008 grams of copper having a particle size of $<1.0$ mm, is preferred.

The loose particals 22, being free to move within the envelope 12, will thus occupy the lowest, and therefore the coolest, portion of the envelope. In such a position, the copper functions as an oxygen getter. If the copper is fixed in position in envelope 12 such that it would be in the upper or hotter portion thereof, it appears as if copper oxides are decomposed, allowing the oxygen to form tungsten oxides which cloud the interior of the envelope.

Thus, this invention allows lamp 10 to be burned in any vertical orientation, i.e., either base up or base down, as well as in a horizontal mode.

While there have been shown and described what are at present considered to be the preferred embodiments of the invention, it will be apparent to those skilled in the art that various changes and modifications can be made herein without departing from the scope of the invention, as defined by the appended claims.

I claim:

1. A tungsten-halogen incandescent lamp comprising: a light transmitting, hermetically sealed, glass envelope; two lead-in wires sealed in said envelope at a glass press and extending internally and externally of said envelope; a tungsten filament attached between the internal ends of said lead-in wires; a fill gas within said envelope comprising an inert gas and a halogen; and a quantity of loose copper particles within said envelope.

2. The lamp of claim 1 wherein said quantity of loose copper particles is sufficient to provide an effective gettering action.

3. The lamp of claim 2 wherein said particles of copper are of a size to not pose a shock hazard to said filament.

* * * * *